US008656684B1

(12) United States Patent
Cullinane et al.

(10) Patent No.: US 8,656,684 B1
(45) Date of Patent: Feb. 25, 2014

(54) METAL DOOR

(71) Applicants: Daniel J. Cullinane, Omaha, NE (US); Ryan D. Steele, Springfield, NE (US)

(72) Inventors: Daniel J. Cullinane, Omaha, NE (US); Ryan D. Steele, Springfield, NE (US)

( * ) Notice: Subject to any disclaimer, the term of this patent is extended or adjusted under 35 U.S.C. 154(b) by 0 days.

(21) Appl. No.: 13/959,853

(22) Filed: Aug. 6, 2013

Related U.S. Application Data

(62) Division of application No. 13/610,110, filed on Sep. 27, 2012, now Pat. No. 8,534,027.

(51) Int. Cl.
*E04C 2/54* (2006.01)

(52) U.S. Cl.
USPC ..... 52/784.15; 52/784.16

(58) Field of Classification Search
USPC ..... 52/784.15, 784.16, 783.1, 656.4, 52/792.11
See application file for complete search history.

(56) References Cited

U.S. PATENT DOCUMENTS

| | | | | | |
|---|---|---|---|---|---|
| 1,848,715 | A * | 3/1932 | Hart et al. | 52/784.13 |
| 2,297,609 | A * | 9/1942 | Clark et al. | 52/784.13 |
| 3,633,312 | A * | 1/1972 | Yeager et al. | 49/503 |
| 3,760,543 | A * | 9/1973 | McAllister | 52/204.591 |
| 4,819,383 | A * | 4/1989 | McKann et al. | 49/501 |
| 4,920,718 | A * | 5/1990 | Artwick et al. | 52/476 |
| 5,417,029 | A * | 5/1995 | Hugus et al. | 52/792.1 |
| 5,570,560 | A * | 11/1996 | Thompson et al. | 52/784.13 |
| 5,644,881 | A * | 7/1997 | Neilly | 52/455 |
| 6,098,368 | A * | 8/2000 | McKann | 52/784.13 |
| 6,161,363 | A * | 12/2000 | Herbst | 52/784.15 |
| 6,272,801 | B1 * | 8/2001 | Suh | 52/211 |
| 6,311,454 | B1 * | 11/2001 | Kempel | 52/784.15 |
| 6,321,505 | B1 | 11/2001 | Packman et al. | |
| 6,389,769 | B1 | 5/2002 | McKinney et al. | |
| 7,797,904 | B2 * | 9/2010 | Wang Chen | 52/592.1 |
| 8,146,304 | B1 * | 4/2012 | Plummer et al. | 52/204.61 |
| 2003/0200714 | A1 * | 10/2003 | Minke et al. | 52/423 |

* cited by examiner

*Primary Examiner* — Basil Katcheves
(74) *Attorney, Agent, or Firm* — Dennis L. Thomte; Thomte Patent Law Office LLC

(57) ABSTRACT

A metal door comprising exterior and interior panel members secured together so as to create a thermal insulating air gap between the back side of the exterior panel member and the front side of the interior panel member.

1 Claim, 7 Drawing Sheets

METAL DOOR

CROSS REFERENCE TO RELATED APPLICATION

This is a Divisional Application of Ser. No. 13/610,110, filed Sep. 27, 2012 entitled METAL DOOR.

BACKGROUND OF THE INVENTION

1. Field of the Invention

This invention relates to a metal door and more particularly to a metal door which is comprised of an exterior panel member and an interior panel member which are secured together by double-sided tape to provide a thermal insulating air gap therebetween.

2. Description of the Related Art

Many types of metal doors have been previously provided. The metal doors of the prior art are very durable and are resistant to forced entry attempts by burglars or the like. A problem associated with the metal doors of the prior art is encountered when the metal doors are subjected to cold temperatures. In such a situation, the inside portion of the metal doors of the prior art may "frost-up" when the metal doors are subjected to very cold temperatures.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A metal door is described which may be a single rectangular-shaped door or a pair of metal doors arranged in a double door fashion. The metal door of this invention is comprised of a metal external panel member having an upper end, a lower end, a first side edge, a second side edge, a front side and a back side. A metal interior panel member having an upper end, a lower end, a first side edge, a second side edge, a front side and a back side is also provided. Each of the panel members is preferably constructed of rectangular tubular steel so that the front and back sides thereof are spaced-apart to provide a chamber or cavity therebetween which is filled with a thermal insulating foam material.

The front side of the interior panel member is positioned adjacent the back side of the exterior panel member. A first length of double-sided adhesive tape adhesively secures the front side of the interior panel member to the back side of the exterior panel member adjacent the upper ends thereof. A second length of double-sided adhesive tape adhesively secures the front side of the interior panel member to the back side of the exterior panel member adjacent the first side edges thereof. A third length of double-sided adhesive tape adhesively secures the front side of the interior panel member to the back side of the exterior panel member adjacent the lower ends thereof. A fourth length of double-sided adhesive tape adhesively secures the front side of the interior panel member to the back side of the exterior panel member adjacent the second side edges thereof.

The thickness of the lengths of the double-sided adhesive tape is sufficient to create a sealed thermal insulating air gap between the back side of the exterior panel member and the front side of the interior panel member. The thermal insulating air gap may be filled with a gas such as argon, Xenon or krypton.

The back side of the exterior panel member has a plurality of spaced-apart holes extending thereinto. The front side of the interior panel member has a plurality of spaced-apart holes extending thereinto which register with the holes in the back side of the exterior panel member. A fastener is positioned in each pair of registering holes in the back side of the exterior panel member and the front side of the interior panel member to further secure the panel members together. Each of the fasteners includes a centrally positioned spacer portion which has a larger diameter than the diameters of the holes in the panel members. Preferably, each of the panel members has at least one cut-out area into which a metal grill and a glass panel may be installed.

It is therefore a principal object of the invention to provide an improved metal door.

A further object of the invention is to provide an improved metal door including an exterior panel member and an interior panel member having double-sided adhesive tape securing the exterior and interior panel members together to form a thermal insulating air gap therebetween.

A further object of the invention is to provide an improved metal door including an exterior panel member and an interior panel member having fasteners securing the exterior and interior panel members together.

A further object of the invention is to provide a metal door of the type described which is durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
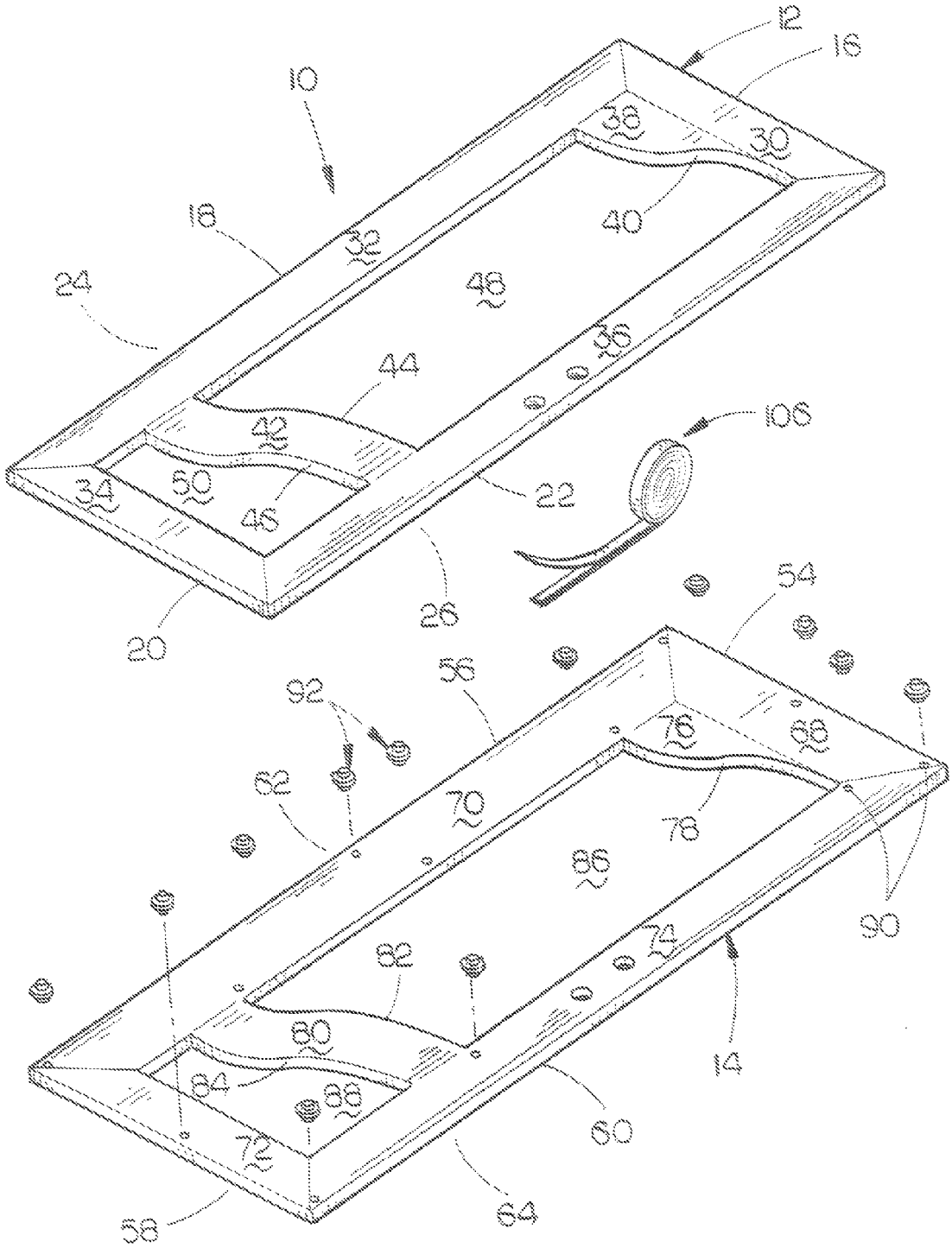
FIG. 1 is an exploded perspective view of the metal door of this invention.
Figure 6:
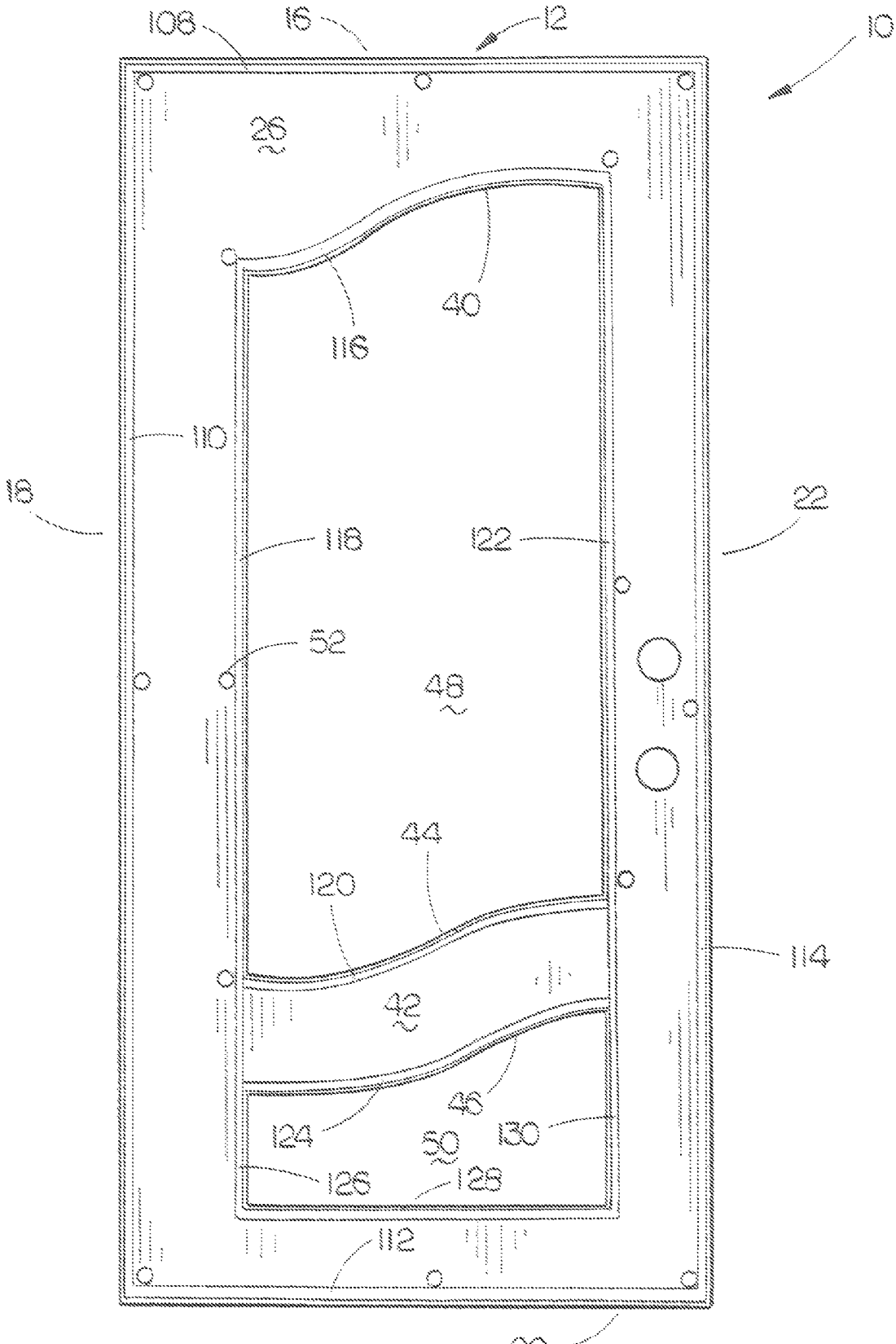
FIG. 6 is a view of the back side of the exterior panel member of the door of this invention.
Figure 7:
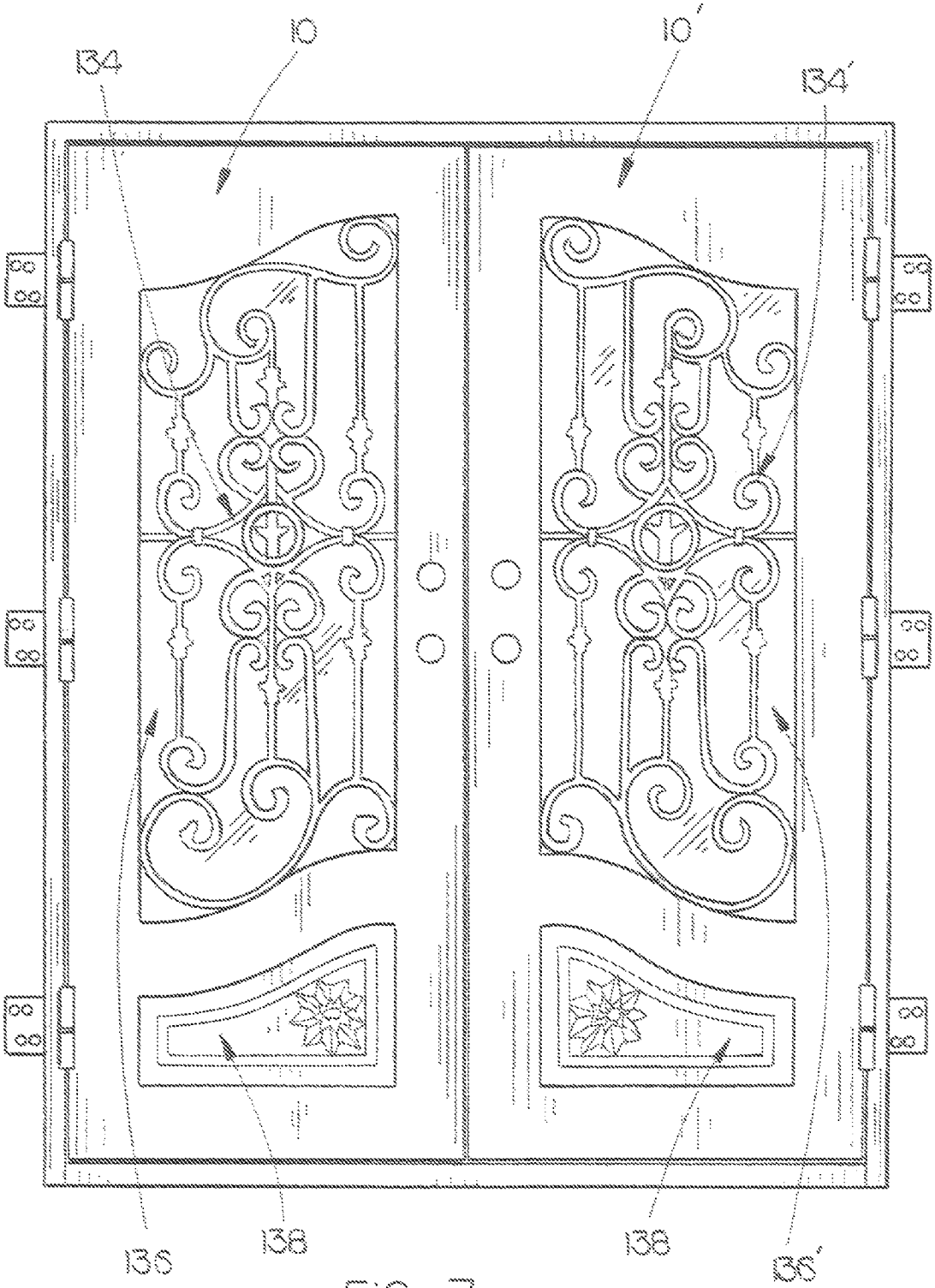
FIG. 7 is a view of the front side of a pair of the doors of this invention mounted in a frame.
Figure 8:
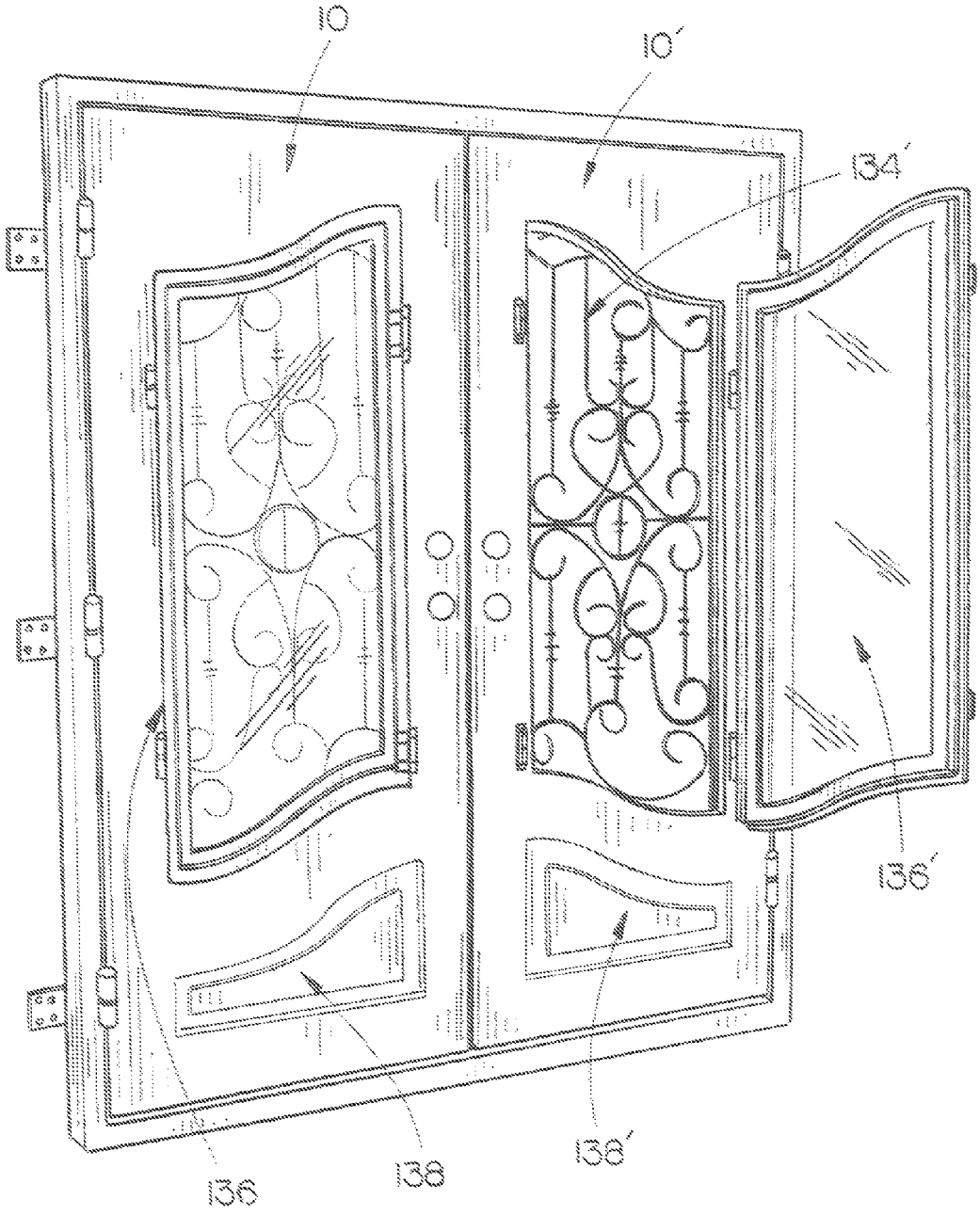
FIG. 8 is a perspective view of the doors of FIG. 7 with one of the glass portions being shown in an open position.

In the drawings, the numeral 10 refers to the door of this invention which is constructed of metal such as iron, steel or aluminum. The door 10 can be installed as a single door as illustrated in FIGS. 1 and 6 or installed as a double door as seen in FIGS. 7 and 8. When installed as a double door, the door 10 is used in conjunction with a door 10' which is a mirror image of door 10.

Door 10 is comprised of an exterior panel member 12 and an interior panel member 14. Panel member 12 will be described as having an upper end 16, a first side edge 18, a lower end 20, a second side edge 22, a front side 24 and a back side 26. Preferably, the thickness of panel member 12 is seven-eighths inch. Panel member 12 may be constructed of a solid sheet of metal but is preferably constructed of rectangular tubular steel so that a cavity or chamber 27 is formed between the front side 24 and back side 26 so as to permit thermal insulating foam 28 to be positioned therein. Panel member 12 is preferably constructed of an upper rectangular tubular steel member 30, a first rectangular tubular steel side member 32, a lower rectangular tubular steel member 34, and a second rectangular tubular steel side member 36. As seen in FIG. 1, the ends of member 30 are mitered and are welded to the mitered upper ends of members 32 and 36. The ends of member 34 are mitered and are welded to the mitered lower ends of members 32 and 36.

Preferably, a rectangular tubular steel member 38, having an arcuate lower end 40, is welded to members 30, 32 and 36. Preferably, a rectangular tubular steel member 42, having an arcuate upper end 44 and an arcuate lower end 46, is welded to and extends between members 32 and 36 above member 34. The members 38 and 44 define a space or open area 48 therebetween. Members 32 and 42 define a space or open area 50 therebetween.

The back side 26 of panel member 12 preferably has a plurality of spaced-apart openings 52 formed therein which extend thereinto. Preferably, the diameter of the openings 52 is 0.394 inches. As will be explained hereinafter, the openings 52 may not be used but are preferred.

Panel member 14 will be described as having an upper end 54, a first side edge 56, a lower end 58, a second side edge 60, a front side 62 and a back side 64. Preferably, the thickness of panel member 14 is seven-eighths inch. Panel member 14 may be constructed of a solid sheet of metal but is preferably constructed of rectangular tubular steel so that a cavity or chamber 65 is formed between the front side 62 and back side 64 so as to permit thermal insulating foam 66 to be positioned therein. Panel 14 is preferably constructed of an upper rectangular tubular steel member 68, a first rectangular tubular steel side member 70, a lower rectangular tubular steel member 72, and a second rectangular tubular steel side member 74. As seen in FIG. 1, the ends of member 68 are mitered and are welded to the mitered upper ends of members 70 and 74. The ends of member 72 are mitered and are welded to the mitered lower ends of members 70 and 74. Preferably, a rectangular tubular steel member 76, having an arcuate lower end 78, is welded to members 68, 70 and 74. Preferably, a rectangular tubular steel member 80, having an arcuate upper end 82 and an arcuate lower end 84, is welded to and extends between members 70 and 74 above member 72. The members 76 and 82 define a space or open area 86 therebetween. Members 72 and 80 define a space or open area 88 therebetween.

The front side 62 of panel member 14 preferably has a plurality of spaced-apart openings 90 formed therein which extend thereinto. Preferably, the diameter of the openings 90 is 0.394 inches. As will be explained hereinafter, the openings 90 may not be used but are preferred.

Figure 3:
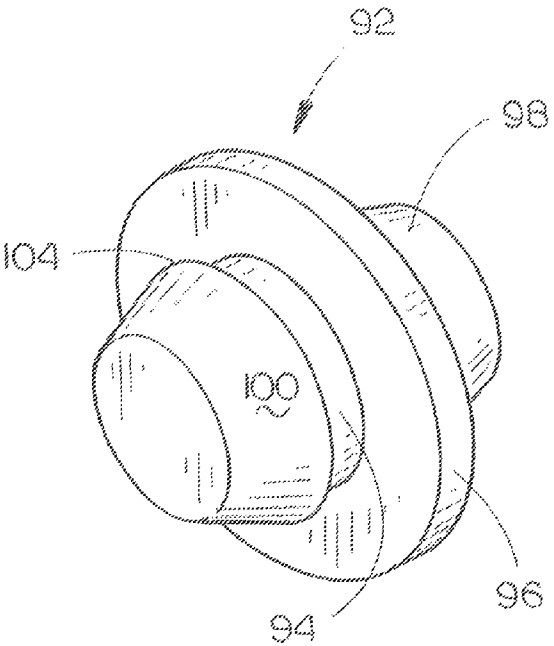
FIG. 3 is a perspective view of one of the fasteners which may be used to further secure the exterior and interior panel members of the door together.
Figure 2:
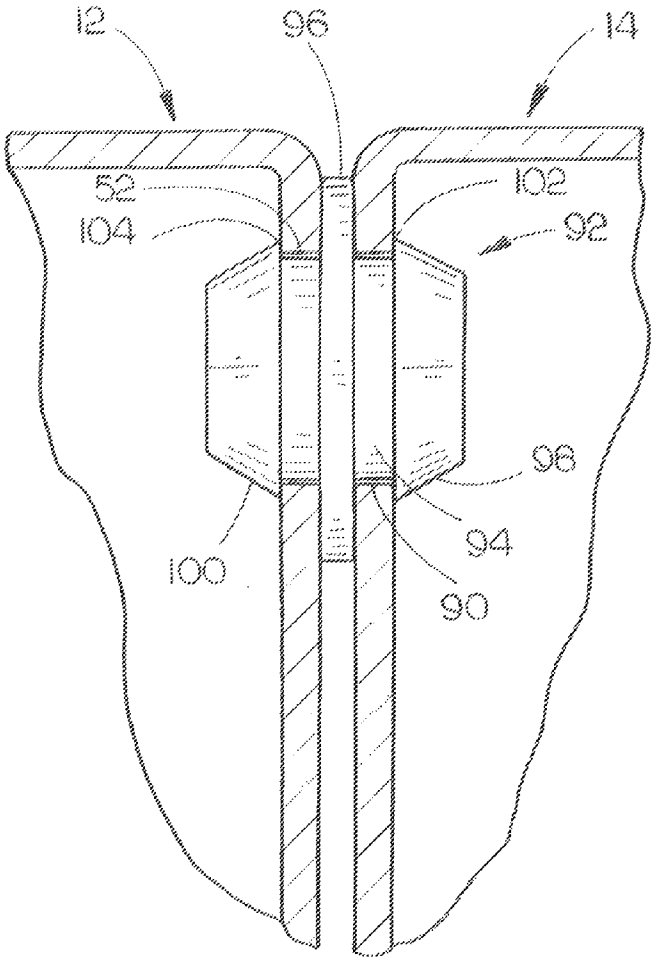
FIG. 2 is a partial sectional view of the door of this invention.
Figure 4:
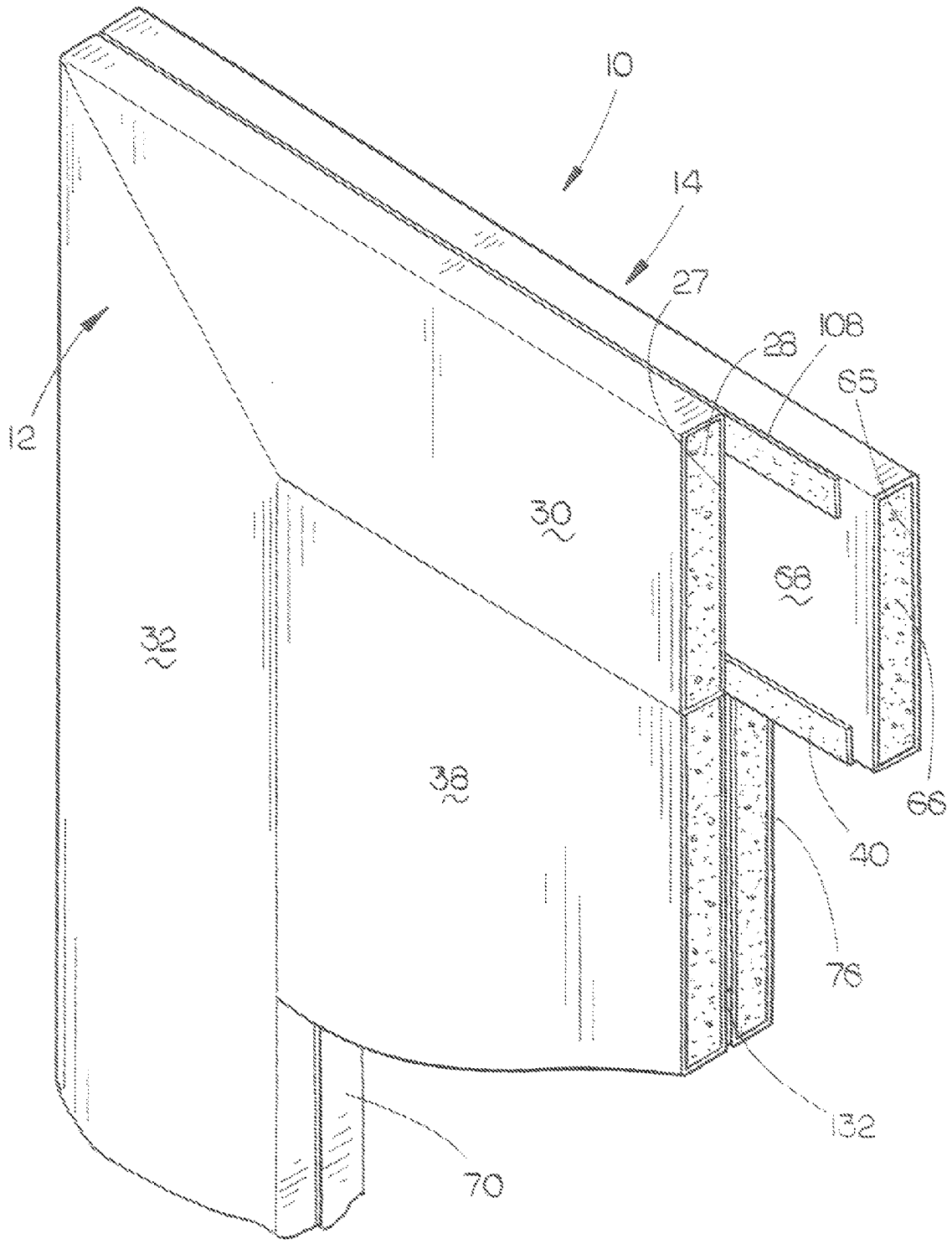
FIG. 4 is a partial sectional view of the door of this invention.

The numeral 92 refers to plastic fasteners which will be used if openings 52 are formed in the back side of panel member 12 and openings 90 are formed in the front side of interior panel member 14. Each of the fasteners 92 include a cylindrical central body portion 94, having a disc-shaped spacer portion 96 extending therefrom as seen in FIGS. 2 and 3. The opposite ends of fastener 92 are beveled at 98 and 100 to form ring-shaped barbs 102 and 104, the outer ends of which have a greater diameter than the diameter of body portion 94 and a greater diameter than the diameters of the openings 52 and 90. Preferably, the diameter of body portion 94 is 8.80 millimeters. The diameter of spacer portion 96 is preferably 1.20 millimeters. The width of the spaced portion is preferably 1.20 millimeters. The distance between barb 102 and spacer portion 96 is preferably 1.60 millimeters. The distance between barb 104 and spacer portion 96 is preferably 1.60 millimeters. The distance between the ends of fasteners 92 is preferably 10.00 millimeters.

The numeral 106 refers to a roll of double-sided adhesive foam tape such as manufactured by 3M as VHB™ Tape No. 4941, which has a thickness of 1.1 millimeters. It may not be necessary to use foam tape if the thickness of the tape is approximately 1.1 millimeters.

A first strip 108 of the adhesive tape is secured to the back side 26 of panel member 12 along the upper end thereof, as seen in FIG. 6. A strip 110 of the adhesive tape is secured to the back side of panel member 12 along side edge 18 as also seen in FIG. 6. A strip 112 of the adhesive tape is secured to the back side of panel member 12 along the lower end thereof and a strip 114 of the adhesive tape is secured to the back side of panel member 12 along the side edge 22 as seen in FIG. 6.

If the door 10 has the spaces 48 and 50 formed therein, strips 116, 118, 120 and 122 of the adhesive tape will be secured to the back side of panel member 12 along the sides and ends of the space 48, as seen in FIG. 6. Strips 124, 126, 128 and 130 of the adhesive tape will be secured to the back side of panel member 12 adjacent the space 50, as seen in FIG. 6.

If the openings 52 and panel member 12 and the openings 90 in panel member 14 are not formed therein, the door 10 will be assembled as follows. The strips of adhesive tape will be secured to the back side of panel member 12 as just described. The front side 62 of panel member 14 will then be positioned adjacent the back side 26 of panel member 12 so as to be aligned therewith. The panel member 14 is then pressed into engagement with the strips of adhesive tape to secure the panel member 14 to the panel member 12. The thickness of the strips of adhesive tape create a thermal insulating air gap 132 between the back side of panel member 12 and the front side of panel member 14. The air gap 132 between the panel members 12 and 14 reduces the possibility of frost forming on the back side of panel member 14 of door 10 when the door 10 is subjected to cold temperatures. Air gap 132 could be filled with a gas such as argon, Xenon or krypton.

If the openings 52 are formed in the back side 26 of panel member 12 and the openings 90 are formed in the front side of panel member 14, the door is assembled as follows. A fastener is inserted into each of the openings 52. As one end of the fastener 92 is pressed through the opening 52, the barb 104 will be compressed and will then expand as illustrated in FIG. 2 to securely hold one end of the fastener 92 in the opening 52. The panel member 14 is then positioned with respect to the panel member 12 so that the fasteners 92 are aligned with the openings 90 in the front side of panel member 14. The panel member 14 is then pressed onto the fasteners 92 with the end of the fasteners 92 moving through the openings 90 with the barb 102 engaging the panel member 14, as seen in FIG. 2. The fasteners 92 securely hold the panel members 12 and 14 together and also assist in the spacing of the panel members 12 and 14 due to the disc-shaped spacer 96 being positioned therebetween. It is preferred that the strips of adhesive tape be used in conjunction with the fasteners 92 but is not necessary. In any case, the outer edges of the air gap 132 will be caulked prior to the door being painted. If the cut-outs or spaces 48 and 50 are formed in the panel members 12 and 14, a metal grill 134 will be installed in space 48 and secured to panel member 12 by conventional means such as welding or the like. If grill 134 is positioned in space 48, a window assembly 136 will be pivotally secured to panel member 14 in space 50 so as to be movable between open and closed positions. If door 10' is used in conjunction with door 10, as seen in FIGS. 7 and 8, grill 134' and window assembly 136' will be mounted in door 10'.

Figure 5:
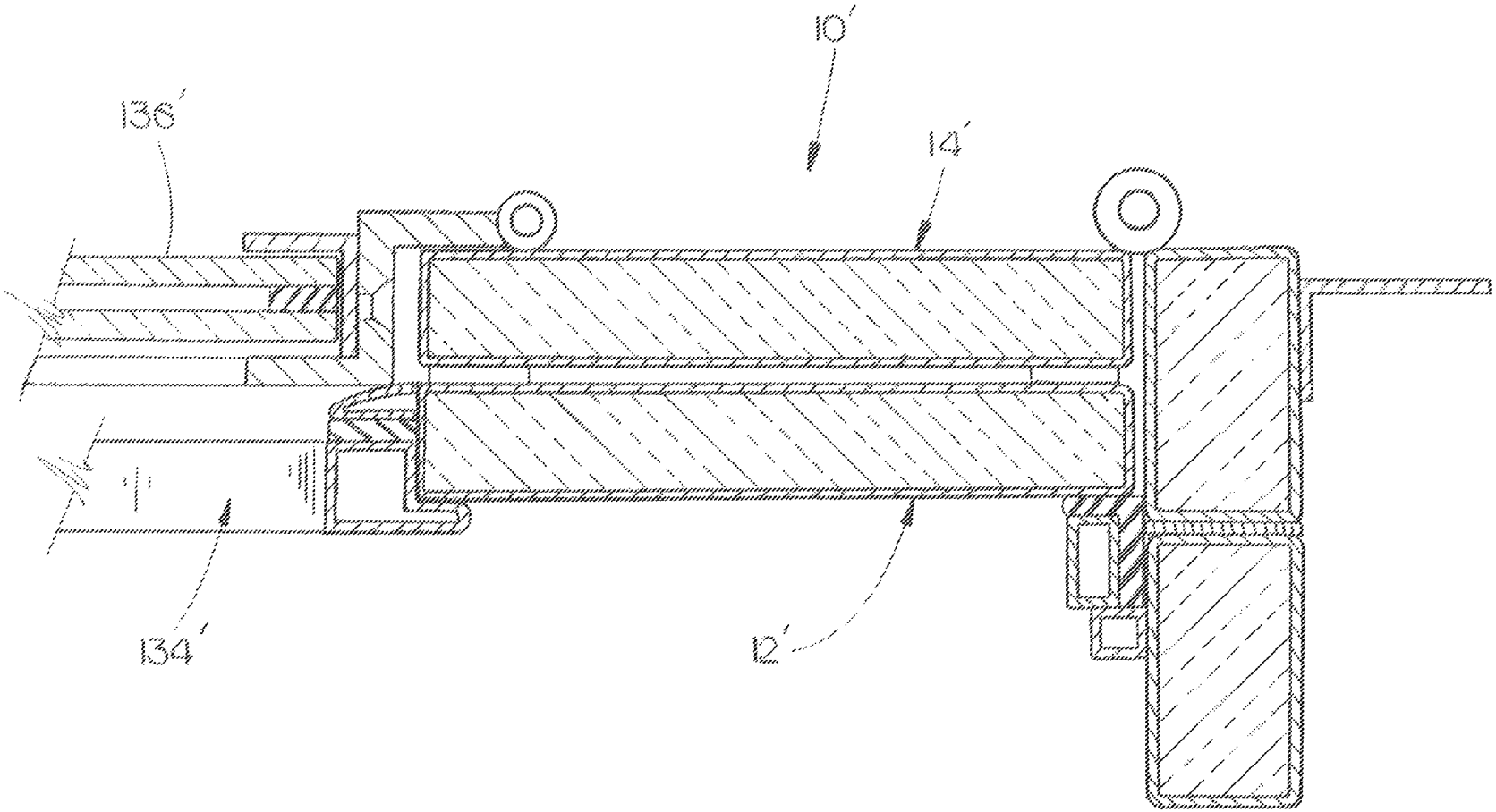
FIG. 5 is a partial sectional view illustrating the door of this invention mounted in a frame.

If spaces 50 and 88 are formed in panel members 12 and 14 respectively, a decorative hollow panel 138 will be installed therein. The panel 138 will also have an air gap 132 formed therein for thermal insulating purposes. FIG. 5 illustrates the panel members 12' and 14' of door 10' mounted in a suitable frame which does not form a part of this invention.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A door comprising:

a metal external panel member having an upper end, a lower end, a first side edge, a second side edge, a front side and a planar back side;

a metal interior panel member having an upper end, a lower end, a first side edge, a second side edge, a planar front side and a back side;

said planar front side of said interior panel member being positioned adjacent said planar back side of said exterior panel member;

a plurality of fasteners being secured to said planar back side of said exterior panel member and said planar front side of said interior panel member and extending therebetween;

said planar back side of said exterior panel member having a plurality of spaced-apart holes extending thereinto;

said planar front side of said interior panel member having a plurality of spaced-apart holes extending thereinto which register with said holes in said planar back side of said exterior panel member;

each of said fasteners having a beveled front end and a beveled back end;

each of said fasteners including a cylindrical central body portion positioned between said beveled front end and said beveled back end thereof;

said cylindrical central body portion of said fasteners having a disc-shaped spacer portion extending therefrom;

said beveled front ends of said fasteners extending into said holes in said planar back side of said exterior panel member and said beveled back ends of said fasteners extending into said holes in said planar front side of said interior panel member with said disc-shaped portions of said fasteners being positioned between planar back side of said exterior panel member and said planar front side of said interior panel member to secure said exterior and interior panel members together;

said fasteners having a length sufficient to space said planar back side of said exterior panel member from said planar front side of said interior panel member to create a thermal insulating air gap between said planar back side of said exterior panel member and said planar front side of said interior panel member.

* * * * *